United States Patent [19]

Blackmon et al.

[11] 4,332,758

[45] Jun. 1, 1982

[54] METHOD FOR PRODUCING POLYESTER WOOL-LIKE YARN

[75] Inventors: Lawrence E. Blackmon, Foley, Ala.; John R. Dees; Wayne T. Mowe, both of Pensacola, Fla.

[73] Assignee: Fiber Industries, Inc., Charlotte, N.C.

[21] Appl. No.: 205,205

[22] Filed: Nov. 10, 1980

Related U.S. Application Data

[63] Continuation-in-part of Ser. No. 972,131, Dec. 21, 1978, abandoned.

[51] Int. Cl.[3] ..... D02G 1/20

[52] U.S. Cl. ..... 264/103; 264/167; 264/168; 264/171; 264/177 F

[58] Field of Search ..... 264/177 F, 103, 167, 264/171, 168; 428/369–371, 399; 425/465

[56] References Cited

U.S. PATENT DOCUMENTS

| | | | |
|---|---|---|---|
| 2,980,492 | 4/1961 | Jamieson et al. | 264/176 F |
| 3,387,327 | 6/1968 | Privott et al. | 264/171 |
| 3,497,585 | 2/1970 | Chapman et al. | 264/171 |
| 3,671,379 | 6/1972 | Evans et al. | 264/171 |
| 4,233,259 | 11/1980 | Pietratus et al. | 425/465 |

FOREIGN PATENT DOCUMENTS

| | | | |
|---|---|---|---|
| 43-8979 | 4/1968 | Japan | 264/171 |
| 42-22339 | 9/1968 | Japan | 264/177 F |
| 44-16804 | 7/1969 | Japan | 264/177 F |
| 49-5903 | 2/1974 | Japan | 425/465 |
| 50-6583 | 3/1975 | Japan | 264/171 |
| 52-66717 | 6/1977 | Japan | 264/177 F |
| 1112938 | 5/1968 | United Kingdom | 264/177 F |

*Primary Examiner*—Jay H. Woo

[57] ABSTRACT

A yarn for producing fabrics with a wool-like hand, by combining textured filaments with longer filaments preferably of larger average denier. The longer filaments thus protrude in loops from the yarn bundle, and have helical cross-sections.

10 Claims, 7 Drawing Figures

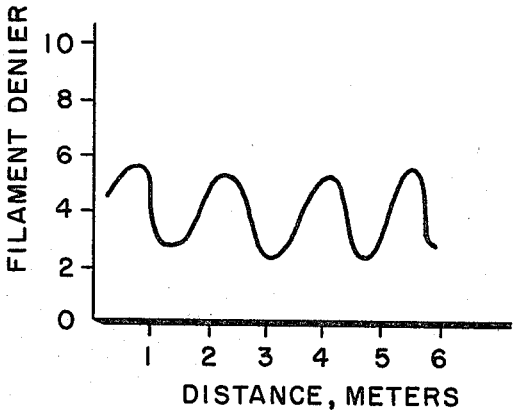
FIG. 5.
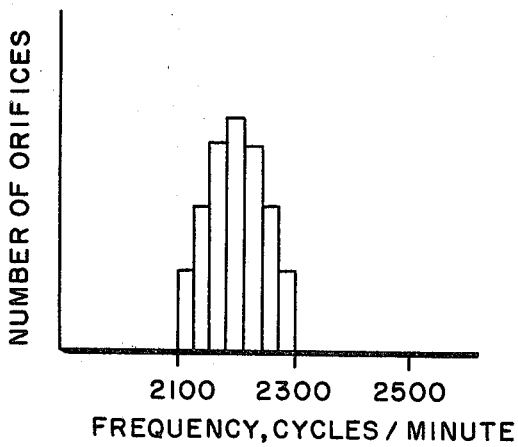
FIG. 6.
FIG. 7.
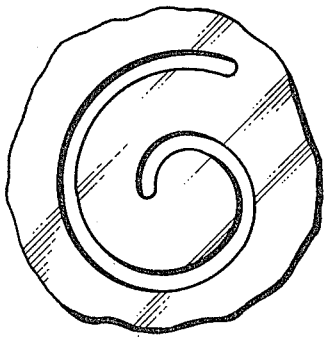

METHOD FOR PRODUCING POLYESTER WOOL-LIKE YARN

This application is a continuation-in-part of U.S. patent application Ser. No. 972,131 filed Dec. 21, 1978 now abandoned.

The invention relates to the art of melt-spun synthetic yarns and processes for their production, and more particularly to such yarns which combine high bulk with a wool-like hand and improved moisture transport.

It is known to produce somewhat bulky yarns by combining filaments with different shrinkages into a yarn, then shrinking so that the resulting longer filaments protrude in loops from the yarn. This may be done by spinning the filaments from different polymers, as in Reese U.S. Pat. No. 3,444,681, or by spinning from different filament cross-sections from a common polymer, as typified by several patents. Such known yarns ordinarily do not have a high bulk, nor do fabrics made therefrom ordinarily provide a hand similar to that of wool, combining an initial crispness on light touch with softness on more firm compression. Nor do such known yarns provide good moisture transport.

These and other difficulties of the prior art are avoided by the present invention, which provides novel and useful processes and improved yarn products.

According to a first major aspect of the invention, there is provided a process for producing a self-crimping yarn comprising first and second types of filaments, said process comprising spinning the first type by forming a first plurality of molten polyester streams having recurring thick and thin regions out of phase from stream to stream; quenching the first plurality of streams into the first type of filaments having thick and thin regions along their lengths and out of phase from filament to filament; spinning the second type by extruding other streams of molten polymer of fiber-forming molecular weight from helical orifices selected to give filaments with helical cross-sections and lower shrinkages than the combined filaments at a given common spinning speed; and quenching the other streams into filaments; withdrawing the first and the second types of filaments from the streams at the common spinning speed; and combining the first and the second types of filaments into a yarn; the thick and thin regions in the first plurality of molten streams and the common spinning speed being selected such that the yarn has a crimp of at least 2%.

According to another aspect, each of the streams is of polyester polymer.

According to another aspect, the spinning speed is selected such that the yarn has a shrinkage below 20%.

According to another aspect, the spinning speed is selected such that the yarn has a shrinkage below 10%.

According to another aspect, the spinning speed is between 5000 and 6000 yards per minute, and each of the first type of filaments is polyester.

According to another aspect, the helical cross-section is open at its inner end.

These and other aspects of the invention will in part appear hereinafter and will in part be obvious in the following detailed description taken in connection with the accompanying drawings wherein:

FIG. 5 is a graph showing how the denier varies with a typical filament spun from the FIG. 1 spinneret;

FIG. 6 is a graph illustrating the distribution of the fluctuations illustrated in FIG. 4 for a representative multiple orifice spinneret according to the invention; and FIG. 7 is a bottom plan view of another spinneret orifice according to the invention.

Figure 1:
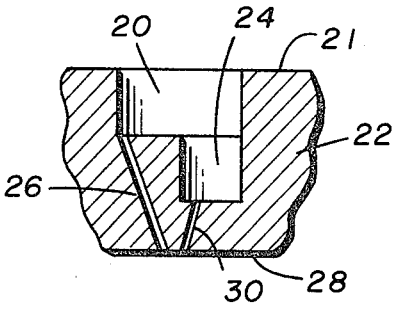
FIG. 1 is a vertical sectional view of a spinneret orifice.
Figure 2:
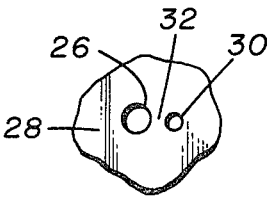
FIG. 2 is a bottom plan view of the FIG. 1 orifice, looking up.

FIGS. 1 and 2 illustrate the preferred embodiment of a spinneret design which can be employed for obtaining the first type of filaments according to the invention. The spinneret includes a large counterbore 20 formed in the upper surface 21 of spinneret plate 22. Small counterbore 24 is formed in the bottom of and at one side of large counterbore 20. A large capillary 26 extends from the bottom of large counterbore 20 at the side opposite small counterbore 24, and connects the bottom of large counterbore 20 with the lower surface 28 of plate 22. Small capillary 30 connects the bottom of counterbore 24 with surface 28. Capillaries 26 and 30 are each inclined four degrees from the vertical, and thus have an included angle of eight degrees. Counterbore 20 has a diameter of 0.113 inch (2.87 mm.), while counterbore 24 has a diameter of 0.052 inch (1.32 mm.). Capillary 26 has a diameter of 0.016 inch (0.406 mm.) and a length of 0.146 inch (3.71 mm.), while capillary 30 has a diameter of 0.009 inch (0.229 mm.) and a length of 0.032 inch (0.813 mm.). Land 32 separates capillaries 26 and 30 as they emerge at surface 28, and has a width of 0.0043 inch (0.109 mm.). Plate 22 has a thickness of 0.554 inch (14.07 mm.). Capillaries 26 and 30 together with counterbores 20 and 24 constitute a combined orifice for spinning various novel and useful filaments according to the invention, as will be more particularly described hereinafter.

Figure 4:
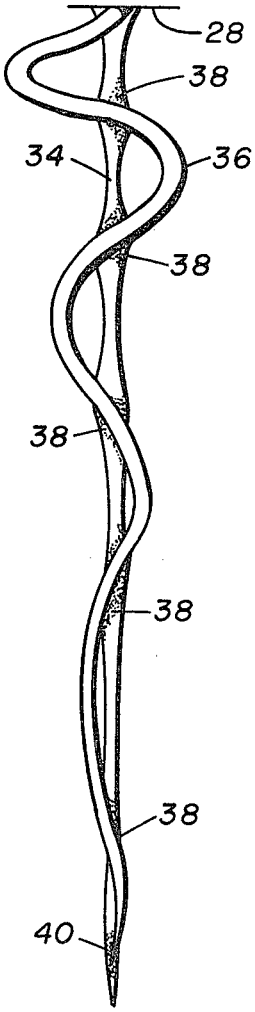
FIG. 4 is a side elevational view of the molten streams issuing from the FIG. 1 spinneret.

When polyester polymer is spun through the combined orifice, a remarkable phenomenon occurs, as illustrated in FIG. 4. Due to the geometry of the spinneret construction, the polymer flowing through the smaller capillaries 30 has a higher velocity than that flowing through the larger capillaries. The speeds and momenta of the paired streams issuing from each combined orifice and the angle at which the streams converge outside the spinneret are such that the slower streams 34 travel in substantially straight lines after the points at which the paired streams first touch and attach, while each of the smaller and faster of the streams 36 forms sinuous loops back and forth between successive points of attachment 38 with its associated larger streams. This action can be readily observed using a stroboscopic light directed onto the stream immediately below the spinneret face 28. As the molten streams accelerate away from the spinneret, the slower stream attenuates between the points of attachment 38 and the loops of the faster stream become straightened until the faster stream is brought into continuous contact with the slower stream. The slower stream attenuates more between than at the points of first attachment, so that the resulting combined stream has a cross-section which is larger at the points of first attachment than in the regions between these points. The resulting combined stream is then further attenuated somewhat until it is solidified into a filament 40 by the transverse quench air.

Figure 3:
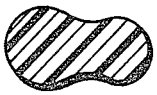
FIG. 3 is a sectional view of a filament spun from the FIG. 1 orifice.

Each solidified filament has non-round cross-sectional areas (FIG. 3) which vary repetitively along its length, the regions of large area having much higher shrinkage than those of small area. As shown qualitatively in FIG. 5, when using the spinning conditions given below, the filament cross-sectional area varies at a repetition rate of the order of magnitude of about one per meter, although this can be varied somewhat by modifying the spinning conditions and the geometry of the spinneret passages.

Due to minor differences between combined orifices, temperature gradations across the spinneret, and other like deviations from exactly the same treatment for each pair of streams, a multiple orifice spinneret will typically provide somewhat different repetition rates among the several resulting streams and filaments. An example of this is qualitatively shown in FIG. 6, wherein is shown that various orifices produce somewhat different repetition rates as determined by stroboscopic examination of the combined streams just below the spinneret face.

When such yarn is heated under low tension, the high shrinkage regions in a filament contract more than the low shrinkage regions in adjacent filaments, which are placed under compression and forced to bulge out and protrude from the yarn bundle, yielding crimp. If the degree of shrinkage amplitude variations were too small, or if the shrinkage amplitude variations along the filaments were in phase, a useful degree of crimp would not be obtained.

Advantageously, the spinneret is so designed that one of the individual streams has a velocity in its capillary between 2.0 and 7 times (preferably between 3.5 and 5.5 times) the velocity of the other of the streams in its capillary. Further advantages are obtained when the faster of the two streams has a smaller cross-sectional area than the slower of the streams, particularly in degree of crimp and spinning stability.

The second class of filaments may be spun from spinneret orifices selected such that, at the given common spinning speed, the filaments of the first class will have a higher shrinkage than those of the second class.

FIG. 7 shows the preferred embodiment of spinneret design which can be employed for obtaining the second type of filament according to the invention. The orifice is in the form of a spiral slot through the spinneret plate and extending over more than 360 degrees. An exemplary slot may have a width of 0.1 mm. and a length of 4 mm. along the length of the spiral. If the clearance between the inner end and the nearest intermediate portion of the slot is sufficiently small, the molten stream issuing therefrom will bridge the gap between the inner end of the spiral cross-sectioned stream and the nearest intermediate portion of the stream cross-section, forming a filament with a helical cross-section closed at its inner end. On the other hand, if the noted clearance is slightly larger, the bridging will not occur, and the resulting filament will have a helical cross-section open at its inner end. Selection of the proper clearance to provide either a closed inner end or an open inner end while using particular spinning and quenching conditions can readily be made by one skilled in the art.

Generally speaking, the filament having a cross-section comprising a spiral closed at its inner end will have a more powerful crimp than one having a cross-section comprising a spiral open at its inner end. The latter will, however, have substantially increased moisture transport and moisture holding capacity as compared to the former, which is itself superior to ordinary round filaments.

As a specific example, molten polyethylene terephthalate polymer of normal molecular weight for textile apparel yarns is extruded simultaneously through two spinnerets, one of which contains 34 combined orifices as above described and the other of which contains 17 spiral slots as above described. The extrusion rates are selected such that each resulting class of filaments has a total denier of 88 at a winding or spinning speed of 5200 ypm (about 4600 meters per minute). The molten streams are quenched into filaments by transversely directed moving air, and the 51 filaments are converged into a common yarn bundle and wound on a bobbin at 5200 ypm as a yarn having a denier of 176.

The yarn is heated to 150° C. while under low tension to develop the latent crimp in those filaments of the first class and to develop the shrinkage differences between the two classes of filaments. Those filaments of the first class, collected separately, have a shrinkage of 17%, while those of the second class, collected separately, have a shrinkage of 3.5%. The combined yarn has a shrinkage of 14%. Each filament of the first class has a periodic variation in denier from approximately one denier to approximately four denier, while the filaments of the second class protrude in relatively large loops from the yarn bundle.

To produce a more wool-like hand, the number or the denier per filament of the filaments of the second class can be increased, the range of about 5–9 dpf being particularly suitable. Moisture transport is increased over prior art yarns, and particularly when the helical cross-section of the second class of filaments is open at the inner end.

DEFINITIONS AND TEST METHODS

"Polyester" as used herein means those polymers of fiber-forming molecular weight composed of at least 85% by weight of an ester or esters of one or more dihydric alcohols and terephthalic acid.

Yarn properties are determined in the following manner. The yarn is conditioned for at least one hour in an atmosphere of 22° C. and 65% relative humidity. If the yarn is wound on a package, at least 100 meters are stripped off and discarded. The yarn is skeined under a tension of 0.035 grams per denier on a Suter denier reel or equivalent device having a perimeter of 1.125 meters per revolution to a total skein denier of approximately (but not to exceed) 8000, and the ends are tied. For example, for a 170 denier yarn, 24 revolutions would give a skein denier of 8160. In this instance, 23 revolutions would be used. The skein is removed from the denier reel and suspended from a 1.27 cm. diameter round bar. A 1000 gram weight is gently lowered until the weight is suspended from the bottom of the skein by a bent #1 paper clip or equivalent piece of wire weighing less than 1 gram. After 30 seconds, the skein length is measured to the nearest 0.1 cm., the measured length being recorded as $L_o$. The 1000 gm. weight is then replaced with a 20 gm. weight, and the rod with the suspended skein and 20 gm. weight are placed in a 120° C. oven for 5 minutes. The rod with the suspended skein and 20 gm. weight is removed from the oven and conditioned for 1 minute at 22° C. and 65% relative humidity, after which the skein length $L_1$ is determined to the nearest 0.1 cm. The 20 gm. weight is then carefully replaced by the 1000 gm. weight. Thirty seconds after the 1000 gm. weight has been applied the skein length $L_2$ is determined to the nearest 0.1 cm. The percentage crimp is then calculated as $$(L_2-L_1)/L_2\times 100$$

while the percentage yarn shrinkage is calculated as $$(L_o-L_2)/L_o\times 100$$

Occasionally the filaments in a skein will be so highly entangled that, when the 20 gm. weight is replaced by the 1000 gm. weight, the length $L_2$ is about the same as $L_1$, even though the skein obviously has not had its crimp pulled out. In such a case, the 1000 gm. weight may be gently jarred until the weight falls and removes the crimp. To characterize a yarn, 100 samples are tested by the procedures in this paragraph, the highest 10 and lowest 10 values being discarded and the remainder averaged to arrive at crimp and shrinkage values for the yarn.

What is claimed is:

1. A process for producing a self-crimping yarn comprising first and second types of filaments, said process comprising:

(a) spinning said first of filament type by (1) forming a first plurality of melt spun filaments by merging molten polyester streams traveling at different extrusion speeds to form thick and thin regions in the merged streams out of phase from other merged streams;

(2) quenching said first plurality of merged streams into said first type of filaments having thick and thin regions along their lengths and out of phase from filament to filament;

(b) spinning said second of filament type by (1) extruding other streams of molten polymer of fiber forming molecular weight from helical orifices selected to give filaments with helical cross-sections and lower shrinkages than said combined filaments at a given common spinning speed; and (2) quenching said other streams into filaments;

(c) withdrawing said first and said second types of filaments from said streams at said common spinning speed; and (d) combining said first and said second types of filaments into a yarn;

(e) said thick and thin regions in said first plurality of molten streams and said common spinning speed being selected such that said yarn has a crimp of at least 2%.

2. The process defined in claim 1, wherein each of said steams is of polyester polymer.

3. The process defined in claim 2, wherein said spinning speed is selected such that said yarn has a shrinkage below 20%.

4. The process defined in claim 3, wherein said spinning speed is selected such that said yarn has a shrinkage below 10%.

5. The process defined in claim 1, wherein said spinning speed is between 5000 and 6000 yards per minute, and wherein each of said first type of filaments is polyester.

6. The process defined in claim 1, wherein said helical cross-section is open at its inner end.

7. The process of claim 1 wherein the first plurality of molten polyester streams are produced by the merging of at least two molten polymer streams wherein one stream is extruded at a velocity of 2.0 to 7 times the velocity of the other stream.

8. The process of claim 7 wherein the extrusion velocity is 3.5 to 5.5 times the velocity of the other stream.

9. The process of claim 1 wherein the two types of filaments are spun from the same polymer.

10. The process of claim 1 wherein the spinning take up speed is sufficiently high such that the yarn can be used in textile applications without further drawing.

* * * * *